United States Patent [19]

Cowell

[11] 4,280,352

[45] Jul. 28, 1981

[54] APPARATUS FOR FORMING CORRUGATED SHEET MATERIAL

[75] Inventor: Timothy A. T. Cowell, Canley, England

[73] Assignee: Covrad Limited, Canley, England

[21] Appl. No.: 65,252

[22] Filed: Aug. 9, 1979

[30] Foreign Application Priority Data

Aug. 15, 1978 [GB] United Kingdom ..... 33425/78

[51] Int. Cl.[3] ..... B21D 13/04; B21D 13/10

[52] U.S. Cl. ..... 72/186; 72/187; 72/379

[58] Field of Search ..... 72/186, 187, 379, 384; 113/1 C

[56] References Cited

U.S. PATENT DOCUMENTS

| | | | |
|---|---|---|---|
| 767,883 | 8/1904 | Grafton | 72/187 X |
| 3,673,846 | 7/1972 | Levington et al. | 72/384 X |
| 3,850,018 | 11/1974 | Drosnin | 72/187 X |
| 3,988,917 | 11/1976 | Mykolenko | 72/187 |
| 4,012,932 | 3/1977 | Gewiss | 72/187 |

FOREIGN PATENT DOCUMENTS

| | | | |
|---|---|---|---|
| 317753 | 12/1919 | Fed. Rep. of Germany | 72/187 |

*Primary Examiner*—Lowell A. Larson

*Attorney, Agent, or Firm*—Wheeler, House, Fuller & Hohenfeldt

[57] ABSTRACT

Apparatus for forming corrugated sheet material includes coacting rolls (10,11) by which material having corrugations with crests and intervening flanks is formed. The crests are closed up to one another by a first pair of rollers (22) which run at relatively high speed followed by a second pair of rollers (27) which run at a relatively low speed. The rollers engage the crests or the side edges of the material to control the rate of feed of the material between each pair of rollers.

The invention finds application in forming corrugated metal sheet for heat exchangers.

7 Claims, 4 Drawing Figures

APPARATUS FOR FORMING CORRUGATED SHEET MATERIAL

Figure 1:
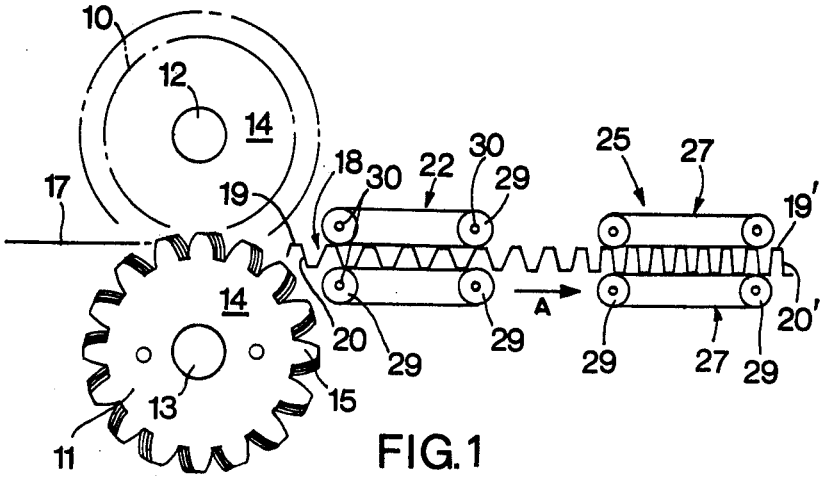

This invention relates to apparatus for making corrugated sheet material.

In our prior application Ser. No. 877,628 filed Feb. 14, 1978, now U.S. Pat. No. 4,170,122, we have described a method of and apparatus for forming corrugations in thin metal sheet to produce corrugated material particularly suitable for use in heat exchangers. The corrugated material formed includes a unitary structure having a plurality of corrugated strips each similarly shaped, and the corrugations in adjacent strips being displaced from one another in the longitudinal direction of the strips. The apparatus for forming such corrugated material includes a pair of rolls driven in opposite directions, the sheet material being fed between the rolls for forming said corrugations.

Corrugated material can be produced in other ways such as, for example, described in British Pat. No. 1,301,665 and in this and the previously described method it may be necessary to effect a further step to produce corrugated material of the desired shape. Such a step may be to close up the corrugations on one another from their extended condition after formation. In British Pat. No. 1,301,665 there is described one way of closing up the corrugations involving the use of endless driven belts above and below the corrugated material and in contact with the material. The material is fed between the belts and to restraining means in the form of plates spring-urged towards one another which engage the sides of the material to reduce the speed of advance of the material thereby causing the corrugations to close up.

The invention is concerned with providing improved means for closing up the corrugations in corrugated material whch is particularly suited to the corrugated material produced by the apparatus described in said application Ser. No. 877,628, now U.S. Pat. No. 4,170,122.

According to the invention apparatus for forming corrugated sheet material comprises corrugation-forming means whereby corrugated material is formed, the corrugations including crests and intervening flanks, the crests being spaced apart in the lengthwise direction of the material, and closing up means for reducing the spacing between the crests, the closing up means including a first pair of rollers rotatable at relatively high speed and a second pair of rollers downstream of the first pair of rollers and rotatable at a relatively lower speed, the rollers of each pair being engageable with opposite surfaces of the corrugated material so that the speed of each pair of rollers controls the rate of feed of the corrugated material between each pair of rollers.

In one embodiment the first pair of rollers may be associated with a further pair of rollers which are rotatable at the same relatively high speed as said first pair of rollers and the rollers of the further pair are located to engage opposite surfaces of the corrugated material. In this case the two pairs of rollers are located in contact with the crests of the corrugated material and may be spaced apart in the widthwise direction of the material. The second pair of rollers may be located centrally of the material and between said first and further pairs of rollers with respect to the lengthwise direction of the material.

In another embodiment of the invention the first pair of rollers are in contact with the side edges of the corrugated material and the second pair of rollers are in contact with the crests on the opposite surfaces of the material. The second pair of rollers may be located centrally of the material with respect to its side edges.

Both of these embodiments are particularly suitable for closing up corrugated sheet material of the kind produced by the apparatus described in U.S. Pat. No. 4,170,122, especially the material described in relation to FIG. 7 of that specification, which it is important to ensure does not become distorted along the central axis of the material.

In each case the rollers are preferably of the form each including an endless band or belt passing around pulleys.

Figure 2:
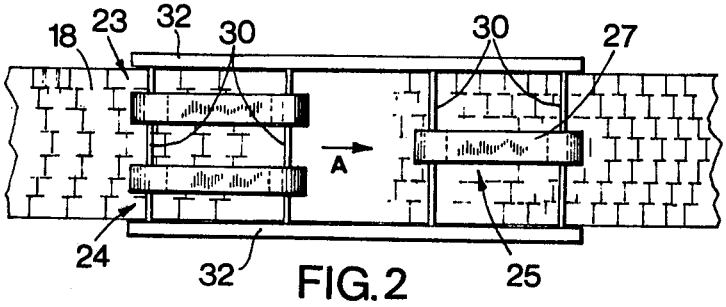
Figure 3:
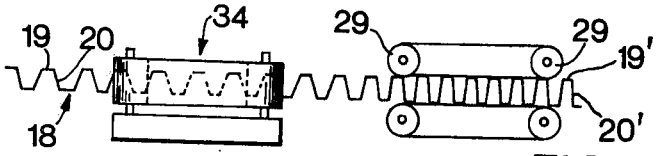
Figure 4:
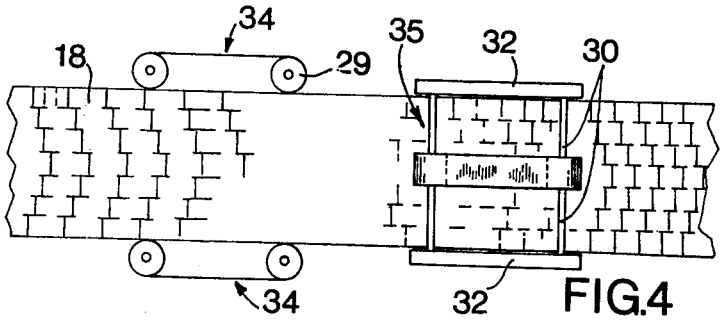

Further features of the invention will become apparent by reference to the accompanying drawings in which:

FIG. 1 is a schematic longitudinal section through one form of apparatus for making corrugated material, FIG. 2 is a plan view of part of the apparatus of FIG. 1, FIG. 3 is a schematic side elevation of another form of apparatus for making corrugated material, and FIG. 4 is a plan view of the apparatus of FIG. 3.

Referring to the drawings and firstly to FIGS. 1 and 2, apparatus for making corrugated material includes a pair of rolls 10 and 11 (only shown in FIG. 1) mounted on parallel shafts 12 and 13 for rotation in opposite directions, one or both the rolls being driven at substantially constant speed by drive means (not shown). Each roll 10, 11 is made up of laminae 14 arranged side by side and in contact with one another and each lamina has an outer profile formed with circumferentially-spaced teeth 15. The teeth 15 constitute a corrugated non re-entrant conjugate profile which is the same for all the laminae of a pair of rolls. Adjacent laminae 14 in each roll are angularly displaced from one another about the axis of an associated roll by a predetermined amount according to the desired form of the corrugated material. The laminae 14 may be of equal widths in the direction of the axes of the rolls or selected laminae may be wider than the others, for example, the end and the centre laminae may be of greater width than the others.

The rolls 10, 11 are arranged so that the teeth 15 mesh together on rotation but a sheet 17 of material can be admitted between the peripheries of the rolls. As the rolls are rotated and the sheet 17 is fed continuously between the rolls, the sheet is drawn between the rolls and is sheared and shaped to form corrugated sheet material 18.

In the illustrated arrangement the angular displacement between the laminae 14 is reversed after the midpoint of the rolls has been passed to produce sheet material 18, as seen in FIG. 2, which is of unitary structure formed of longitudinally extending strips each having crests 19 and intervening flanks 20, the crests being spaced apart in the lengthwise direction of the material and being generally disposed in a chevron arrangement.

As thus far described the apparatus is of the form described in said U.S. Pat. No. 4,170,122 with reference to FIG. 2 thereof, arranged to produce corrugated material of the form shown in FIG. 7 thereof, the corrugations in side elevation being of the form seen in FIG. 4 of that application. However, the invention is not intended to be limited to this arrangement.

After leaving the rolls 10, 11 the material 18 is subjected to a further step in its formation. During this step the crests 19 of the corrugations are moved closer together in the longitudinal direction thereby 'closing up' the corrugated material. This is achieved in the embodiment of FIGS. 1 and 2 by two sets of roller bands, a first set 22 including two pairs 23 and 24 of bands, the roller bands of each pair being located to engage opposite surfaces of the material 18 and in contact with the crests 19 of the material. The pairs 23 and 24 are spaced apart from one another across the width of the material 18 and are located to either side of the central portion of the material adjacent the side edges of the material.

Downstream of and spaced apart from the first set 22 of roller bands is a second set 25 of roller bands including a single pair of bands 27 located to engage opposite surfaces of the material and in contact with the crests 19. The pair of bands 27 is located centrally of the material in the widthwise direction so that it lies between the bands 23 and 24 with respect to the direction of movement of the material.

The bands 23, 24 of the first set 22 all rotate at the same speed, the bands of each pair rotating in opposite directions to one another. Similarly each band of the pair of bands 27 rotate at the same speed as one another but in opposite directions.

In order to effect the closing up of the corrugations in the material, the first set of bands 22 rotate faster than the second set 25 of bands, the relative speeds being selected according to the amount by which the crests are to be closed up to one another.

Each of the bands in the pairs of bands 23, 24 and 27 is in the form of an endless belt passing around two pulleys 29 carried on shafts 30. One or both of the shafts 30 for each band are driven by drive means (not shown) and the shafts are supported on side plates 32 to each side of the material 18, the side plates also acting to guide the material.

Referring now to FIGS. 3 and 4 showing a further embodiment, the rolls 10 and 11 of the previous embodiment are not shown but the corrugation forming apparatus is generally similar to FIGS. 1 and 2 embodiment, except that the first set 22 of roller bands is replaced by a different arrangement of bands. In this case the first set consists of one pair of roller bands 34, each band of the pair 34 engaging a side edge of the material 18, the bands being at opposite sides thereof. The bands 34 of the pair extend the full height of the corrugations and are driven in the opposite direction to and at the same speed as one another. A second pair 35 of bands similar to the pair 25 of the previous embodiment is located downstream of the pair of bands 34 and centrally of the material so that the bands of the pair 35 are in contact with the opposite surfaces of the material to contact the crests 19. The pair of bands 34 rotate at a higher speed than the second pair of bands 35 to effect the desired closing up action of the corrugations.

In each of the embodiments the second pair 25 or 35 of bands has its leading end a predetermined distance from the trailing end of the preceding bands 23, 24 or 34 and this distance may be adjustable.

It will be appreciated that with this kind of corrugated material, with the corrugations in 'chevron' form as shown, and such as shown in FIG. 7 of said U.S. Pat. No. 4,170,122, in passing to closing-up means there will be a tendency for the material to fold along its longitudinal axis or central strip 21, but the illustrated arrangements overcome this problem, by having in the arrangements illustrated the slower-moving downstream set of rollers at the apex of the 'chevron' and the faster-moving upstream set of rollers at or near the outside edges. It will be appreciated that the same principle may be applied when the corrugations are of other than simple 'chevron' form; e.g. in the form shown in FIG. 8 of said application if the material is moving from left to right, a slower-moving downstream set will co-operate with the outside and central corrugated strips and the faster-moving upstream set will co-operate with the corrugations midway between the central and outside corrugations.

Likewise if the 'chevron' of FIG. 2 of the present application were reversed (i.e. if one envisages the material 18 moving from right to left in the drawing) then the central set 25 will be the faster moving upstream set, and the two spaced-apart pairs of bands 23, 24 will be the slower-moving downstream set.

In each of the illustrated embodiments the corrugations present, in cross-section, crests 19 which are flat on both the upper and lower surfaces of the material, and flat intervening flanks 20 contiguous with the crests through a bend or angle. The action of closing up the crests results in the angle between the crests and flanks decreasing to that shown between crests 19' and flanks 20' in FIGS. 1 and 3, but this angle can be varied as desired by adjusting the relative speeds of the bands as described.

What I claim as my invention and desire to secure by Letters Patent of the United States is:

1. Apparatus for forming corrugated sheet material comprising corrugation-forming means whereby corrugated material of unitary structure is formed and moved in a longitudinal direction, the material having a plurality of interconnected corrugated strips each with crests and intervening flanks, the corrugations in adjacent strips are displaced from one another in the longitudinal direction of the strips to give a chevron formation of the strips, and the crests in each strip are spaced apart from one another; and closing up means for reducing the spacing between the crests; the closing up means including at least a first pair of rollers spaced apart transversely of the direction of travel of the corrugated material between the rollers, and a second pair of rollers located centrally relative to the first pair of rollers, the first and second pairs of rollers being rotatable at different speeds, the higher speed rollers being upstream of the lower speed rollers with respect to the direction of travel of the corrugated material, and the rollers of each pair of being engageable with opposite sides of the corrugated material so that the speeds of the pairs of rollers control the rate of feed of the corrugated material between the rollers.

2. Apparatus according to claim 1 wherein the first pair of rollers are upstream of and rotatable at a relatively higher speed than the second pair of rollers.

3. Apparatus according to claim 2 comprising at least two pairs of upstream rollers, and the upstream and downstream pairs of rollers are engageable with the crests of the corrugated material.

4. Apparatus according to claim 2 comprising an upstream pair of rollers which are in contact with opposite sides edges of the corrugatd material and the downstream pair of rollers are in contact with the crests of the material.

5. Apparatus according to claim 4 wherein the downstream pair of rollers is located centrally of the material with respect to the side edges.

6. Apparatus according to claim 1 wherein each of the rollers in a pair is in a form including an endless band passing around pulleys.

7. Apparatus according to claim 1 comprising guide means at the lateral edges of the material to constrain sideways movement of the material.

* * * * *